United States Patent [19]

Carruthers

[11] Patent Number: 4,705,116

[45] Date of Patent: Nov. 10, 1987

[54] MOLE WITH ROTARY VIBRATOR

[75] Inventor: Alec R. Carruthers, Westbury, England

[73] Assignee: ALH Systems, Ltd., England

[21] Appl. No.: 796,728

[22] Filed: Nov. 12, 1985

[51] Int. Cl.[4] ..... E21B 7/26

[52] U.S. Cl. ..... 175/19; 175/56; 405/146; 37/DIG. 18

[58] Field of Search ..... 175/19, 20, 55, 56, 175/298; 173/91, 93.5; 37/80 R, 193, DIG. 18; 405/146, 154

[56] References Cited

U.S. PATENT DOCUMENTS

| | | | |
|---|---|---|---|
| 2,229,912 | 1/1941 | Baily | 175/56 |
| 2,951,681 | 9/1960 | Degen | 175/56 |
| 3,309,877 | 3/1967 | Degen | 175/55 |
| 3,550,698 | 12/1970 | Pauley | 175/19 |
| 3,800,889 | 4/1974 | Bauer | 175/19 |
| 4,507,019 | 3/1985 | Thompson | 405/154 |

FOREIGN PATENT DOCUMENTS

| | | | |
|---|---|---|---|
| 0158102 | 3/1972 | New Zealand . | |
| 0158087 | 3/1972 | New Zealand . | |
| 0094694 | 11/1983 | United Kingdom | 405/154 |

*Primary Examiner*—Stephen J. Novosad
*Assistant Examiner*—Terry Lee Melius
*Attorney, Agent, or Firm*—Larson and Taylor

[57] ABSTRACT

A ground boring tool known as a mole is fitted within its conical head (1) with a pneumatic-powered rotatory vibrator (8) which generates severe radial vibrations. As a result the progress of the mole through resistant ground is speeded or made possible. The mole also may be used for upgrading existing ducts with or without the destruction of an existing lining to such ducts. For destruction of existing linings elongate ridges (16) may be positioned on the surface of the cone.

3 Claims, 3 Drawing Figures

MOLE WITH ROTARY VIBRATOR

This invention relates to moles, which are tools for forming, clearing or enlarging bores in the ground.

The need for renewal and uprating of pipelines for services such as gas, water and sewage has recently given rise to processes wherein a fresh lining is placed within the existing pipeline passage with the new lining being superior to the old, for example being more impermeable or more resistant to disruption. For uprating, increase in the diameter of the pipeline may be involved and for this purpose a tool may be passed along the pipeline which breaks up the old lining such as the old cast iron or earthenware pipes and increases the bore. The new pipe may be drawn in behind the tool so that under good conditions new installation of an uprated pipeline may be completed in a single pass. However it may be inserted at a later date. Similar processes are used to form holes in virgin ground, and then service ducts may then be pushed or pulled through the holes.

Problems arise however because the rate of progress of the tool through the ground, the old pipeline or the sewer may be too slow and the resistance offered to its progress may result in frequent breakdowns.

The present invention concerns a mole which aims to allow increased rates of operation in the renewal (and, optionally, the uprating) of pipelines and which is also useful to penetrate where no previous duct existed; that is, it can be used to penetrate the ground to form a new pipeline bore or even to form vertical or inclined bores.

The mole according to the invention is adapted to be drawn or pushed into or through the ground (either through solid ground or through an existing duct in the ground). It has a conically divergent leading part which has a rotary vibrator mounted within it.

Such vibrators are known per se and are comparatively simple devices in which a weight is rotated eccentrically, to develop severe radial vibrations through the creation of out-of-balance forces in the radial plane. They are conventionally used for example in screening (sieving) conveyors, road rollers and to dislodge loads from tipping vehicles. They may be mechanically, electrically, pneumatically or hydraulically driven and for the present purposes a pneumatically driven such rotary vibrator is preferred.

In one embodiment of the invention the rear surface of the conically divergent leading part of the tool offers a rearwardly facing opening into which the body of a vibrator tool is push fitted and is then axially retained by fitting a removable plate behind it. Motive power for the tool such as compressed air is fed to it from behind the tool (that is to say through the passageway which it has opened up as it progresses), or from the front.

Forward motion of the tool may be caused either by a ram behind it or more usually from a rod or cable drawn in front of it.

A cone angle of inclination of 10°–20°, more preferably about 15° is found to be suitable, although other greater angles may be used.

The eccentric force developed by the vibrator and the amplitude of radial vibration as well as its frequency may range widely according to the ground conditions encountered and/or the nature of the pipe which is to be broken up (when renewal is involved). For example, centrifugal force of between 5 kNs and 60 kNs may be developed with vibration amplitudes between 1 mm and about 7 mm at vibration frequencies of between 9,000 and 15,000 per minute.

Determination of the best values for any given situation will largely be as a result of experience if only because ground characteristics are unpredictable along the length of a pipeline. Further characteristics which may need to be borne in mind are the propulsive force available for the tool, its cone angle and the drag on its surface, the ratio of the existing diameter to the enlarged diameter to be provided (in the case of the uprating of a pipeline) and the optimisation of the rate of progress.

Particular embodiments of the invention will now be described by reference to the accompanying drawings wherein.

Figure 1:
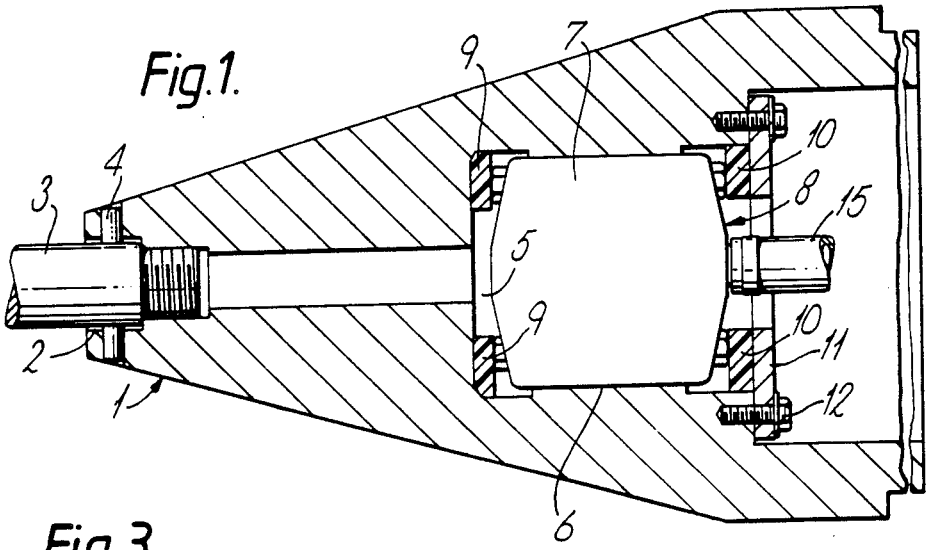
FIG. 1 is a diametrical section through the head of the mole

A steel cone 1 has an axial void through its centre, the leading end of which 2 is enlarged to receive the tail end of a traction rod 3 coupled to the cone by a pin 4.

At the rear end of the void there is an enlargement 5 a circumferential wall of which has a land 6 which is a push-fit onto the outer surface of the body 7 of a rotary vibrator 8. At its axially leading end the vibrator 8 fits snugly against blocks 9 on an axial wall of the enlargements and at its other axial end similar blocks 10 are held against the rear end of the vibrator by an annular retaining plate 11 held to a rear face of the cone by bolts 12. At its trailing end the tool has a cylindrical wall the rear end of which may be used for the attachment of a pipe liner to be drawn through the hole in the ground formed, enlarged or cleared by the tool.

The vibrator 8 is of a type known per se with a pneumatic motor rotating an eccentric tubular weight. Air at appropriate pressure is fed to the motor through pipeline 15 which follows the tool along the bore which it forms. The source of air is conveniently at ground surface.

More specifically a Vibtec VE120 vibrator provided with air at 140 cfm (cubic feet per minute) at various pressures was fitted in the structure seen in FIG. 1. The mole was pulled by a rod drawn by a Petersen hydraulic rodding unit from an excavation made ahead of the tool, the traction rod being pushed through to the tool, attached by a pin 4 and then drawn back. The power pack of the rodding unit was operated at various pressures with and without the vibrator in operation. The cone was 250 mm diameter, with a cone angle of 15°.

The cone was tested through a bed of blue clay at a depth below the surface of approximately 1.5 meters. At 41 bar pressure in the power pack of the rodding unit the cone would not move but when the vibrator was operated it made steady though slow progress. When the power pack was operated at 54 bar pressure the cone moved slowly, but use of the vibrator was found to double its speed of progress. This was a very severe test being in solid damp clay. For these conditions larger vibrating forces and larger amplitudes of vibration (in the model used it was about 1.5 mm) would be preferred, provided for example by a Vibtec VE4500.

In clearing out or uprating an existing duct however, or in penetrating in less arduous soil conditions the first-described vibrator should be adequate.

Improved performance may be obtained by the addition of stress-raising shapes to the surface of the cone 1'.

Figure 3:
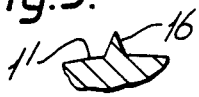
FIG. 3 is a part section through the modified mole.
Figure 2:
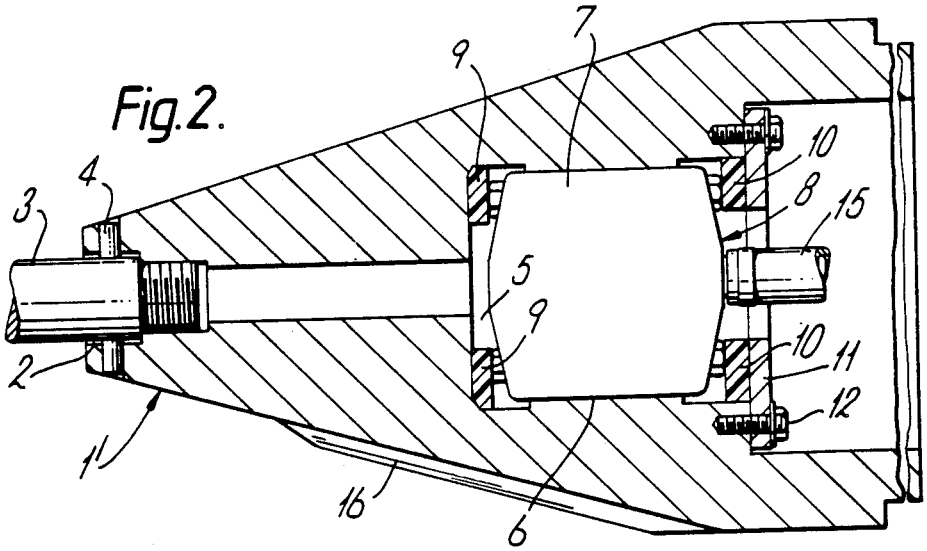
FIG. 2 is a diametrical section through the head of a modified mole.

One such shape is a knife-edge ridge 16 as shown in FIGS. 2 and 3. These knife-edges (stress raisers) of which one, two or more may be provided, create bending, and points of stress concentration which are very effective especially in breaking materials such as cast-iron and vitreous clay.

A mole embodying the invention may be used behind another but conventional mole e.g. as a rounding or upgrading mole behind a conventional duct-breaking mole some of which do not leave a circular-section passage behind them.

What is claimed is:

1. A method of breaking out an existing frangible lining of an underground, essentially horizontal duct, said method comprising:

using traction means to draw through a said duct a mole having a conical head which is oversized with respect to the diameter of the frangible duct lining;

using liquid pressure drive means to generate in a rotary vibrator in said mole high frequency rotational vibrations of said head; and supplying power to the liquid pressure drive means from the traction means, whereby to break the duct lining by virture of said rotational vibrations.

2. Method according to claim 1 wherein said vibrations have an amplitude of between 1 and 7 mm.

3. Method according to claim 1 wherein said vibrations have a frequency between 9000 and 15000 vibrations per minute.

* * * * *